US006911957B2

(12) United States Patent
Brown et al.

(10) Patent No.: US 6,911,957 B2
(45) Date of Patent: Jun. 28, 2005

(54) DYNAMICALLY VARIABLE FREQUENCY SELECTIVE SURFACE

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/620,483

(22) Filed: Jul. 16, 2003

(65) Prior Publication Data

US 2005/0012677 A1 Jan. 20, 2005

(51) Int. Cl.[7] ..... H01Q 15/14
(52) U.S. Cl. ..... 343/911 R
(58) Field of Search ..... 343/909, 700 MS, 343/770, 749, 915, 878, 880, 881, 911 R

(56) References Cited

U.S. PATENT DOCUMENTS

| | | | | |
|---|---|---|---|---|
| 3,231,892 | A | 1/1966 | Matson et al. | |
| 5,792,236 | A | 8/1998 | Taylor et al. | |
| 6,411,261 | B1 * | 6/2002 | Lilly | 343/756 |
| 6,512,496 | B2 | 1/2003 | Alexeff et al. | |
| 6,646,605 | B2 * | 11/2003 | McKinzie, III et al. | 343/700 MS |
| 2002/0167456 | A1 * | 11/2002 | McKinzie | 343/909 |
| 2003/0071763 | A1 * | 4/2003 | McKinzie et al. | 343/909 |
| 2003/0112186 | A1 * | 6/2003 | Sanchez et al. | 343/700 MS |
| 2003/0142036 | A1 * | 7/2003 | Wilhelm et al. | 343/909 |
| 2003/0160724 | A1 | 8/2003 | Alexeff et al. | |
| 2004/0130497 | A1 | 7/2004 | Alexeff et al. | |

OTHER PUBLICATIONS

U.S. Appl. No. 10/626,090, filed Jul. 24, 2003, Brown et al.
U.S. Appl. No. 10/625,977, filed Jul. 24, 2003, Rawnick et al.
U.S. Appl. No. 10/614,149, filed Jul. 7, 2003, Brown et al.
U.S. Appl. No. 10/640,237, filed Aug. 13, 2003, Rawnick et al.
U.S. Appl. No. 10/648913, filed Aug. 27, 2003, Brown et al.
U.S. Appl. No. 10/414,695, filed Apr. 16, 2003, Rawnick et al.
U.S. Appl. No. 10/460,947, filed Jun. 13, 2003, Rawnick et al.
U.S. Appl. No. 10/421,305, filed Apr. 23, 2003, Rawnick et al.

* cited by examiner

*Primary Examiner*—Don Wong
*Assistant Examiner*—Minh Dieu A
(74) *Attorney, Agent, or Firm*—Sacco & Associates, PA

(57) ABSTRACT

Method for dynamically varying a frequency response of a frequency selective surface. The method can include controlling transmission of electromagnetic energy through a frequency selective surface by passing selected frequencies in a pass-band and blocking selected frequencies in a stop-band. The stop-band and the pass-band can be dynamically modified by controlling at least one of a position and a volume of a conductive fluid that forms a portion of the frequency selective surface. According to one aspect of the method, the conductive fluid can be selected to include gallium and indium alloyed with a material selected from the group consisting of tin, copper, zinc and bismuth.

24 Claims, 7 Drawing Sheets

DYNAMICALLY VARIABLE FREQUENCY SELECTIVE SURFACE

BACKGROUND OF THE INVENTION

1. Statement of the Technical Field

The inventive arrangements relate generally to methods and apparatus for frequency selective surfaces, and more particularly to frequency selective surfaces in which the element geometry can be dynamically modified.

2. Description of the Related Art

A frequency selective surface (FSS) is conventionally designed to either block or pass electromagnetic waves at a selected frequency. These types of surfaces are essentially periodic resonance structures that are comprised of a conducting sheet periodically perforated with closely spaced apertures, or may be comprised of an array of periodic metallic patches. FSS structures can generally be separated into two broad categories, namely inductive and capacitive type geometries. An inductive FSS, operates in a manner similar to a high-pass filter. A capacitive FSS, behaves in a manner that is similar to a low-pass filter. When the periodic elements comprising an inductive FSS are at resonance, the FSS will pass RF signals that are at or near the resonant frequency. In contrast, the capacitive FSS will reflect signals at or near the resonant frequency of the elements.

A typical capacitive FSS is constructed out of periodic rectangular metal patches disposed on a planar substrate. By comparison, an inductive type FSS is typically constructed using periodic rectangular apertures which are formed by perforating a metal sheet that has been deposited on a substrate. Many other types of FSS element configurations are known, including tripoles, circles, Jerusalem crosses, concentric rings, mesh-patch arrays or double squares supported by a dielectric substrate. Depending upon the geometry selected, these can combine features of inductive and capacitive elements and can be used to provide low-pass, high-pass, or band-pass responses. U.S. Pat. No. 3,231,892 describes some basic FSS geometries and one potential application for an FSS type periodic resonance structure.

SUMMARY OF THE INVENTION

The invention concerns a method for dynamically varying a frequency response of a frequency selective surface. The method can include controlling transmission of electromagnetic energy through a frequency selective surface by passing selected frequencies in a pass-band and blocking selected frequencies in a stop-band. The stop-band and the pass-band can be dynamically modified by controlling at least one of a position and a volume of a conductive fluid that forms a portion of the frequency selective surface. According to one aspect of the method, the conductive fluid can be selected to include gallium and indium alloyed with a material selected from the group consisting of tin, copper, zinc and bismuth.

The method can also include the step of selecting a geometry for the elements forming the frequency selective surface. For example, the geometry can be chosen so that the elements define tripoles, circles, crosses, Jerusalem crosses, rings, rectangles and squares. The conductive fluid can be used to change at least one dimension of the elements. The conductive fluid can also be used to change a shape of the elements.

The method can also include the step of forming a plurality of elements of the frequency selective surface as periodic perforations in the form of the selected geometry in a conductive ground plane. In that case, the step of modifying the stop-band and the pass-band can further include injecting the conductive fluid into a fluid channel formed adjacent to a portion of the conductive ground plane. Further, the conductive fluid contained in the channel can be electrically coupled to the conductive ground plane so that the ground plane and the conductive fluid are at the same electrical potential. The position and the volume of the conductive fluid contained in the channel can be varied in response to a control signal for modifying the pass-band and the stop-band of the frequency selective surface.

The method further include the step of disposing the conductive ground plane on a dielectric substrate. In that case, the conductive fluid can advantageously be stored in a cavity structure defined within the dielectric substrate. For example, the invention can include the step of forming the cavity structure within a portion of the dielectric substrate entirely within a boundary or perimeter defined by the conductive ground plane so as to shield the cavity structure from interfering with the operation of the frequency selective surface.

The invention can also include a dynamically variable frequency selective surface. The frequency selective surface can be formed of a periodic resonance structure having a plurality of elements periodically spaced over a surface. A fluid control system is provided for dynamically varying one or more of a position and a volume of the conductive fluid within the periodic resonance structure. In this way, the conductive fluid can be used to change at least one dimension of each of the elements. This modification of the element dimensions allows the fluid control system to dynamically modify the resonant frequency of each element.

According to one aspect of the invention, the plurality of elements can be comprised of periodic perforations of a selected geometry in a conductive ground plane. The fluid control system can selectively add and remove the conductive fluid from a fluid channel that can be formed adjacent to a portion of the conductive ground plane. The conductive fluid contained in the channel is advantageously electrically coupled to the conductive ground plane so that the conductive fluid is at the same relative potential as the ground plane. Consequently, the conductive fluid appears to be an extension of the ground plane which can effectively modify a dimension or shape of the perforation defining the element.

According to another aspect of the invention, the conductive ground plane can be disposed on a dielectric substrate and a cavity structure can be defined within the dielectric substrate for storing a predetermined volume of the conductive fluid. For example, the cavity structure can be disposed within a portion of the dielectric substrate entirely within a boundary or perimeter defined by the conductive ground plane.

DETAILED DESCRIPTION OF THE PREFERRED EMBODIMENTS

Figure 1:
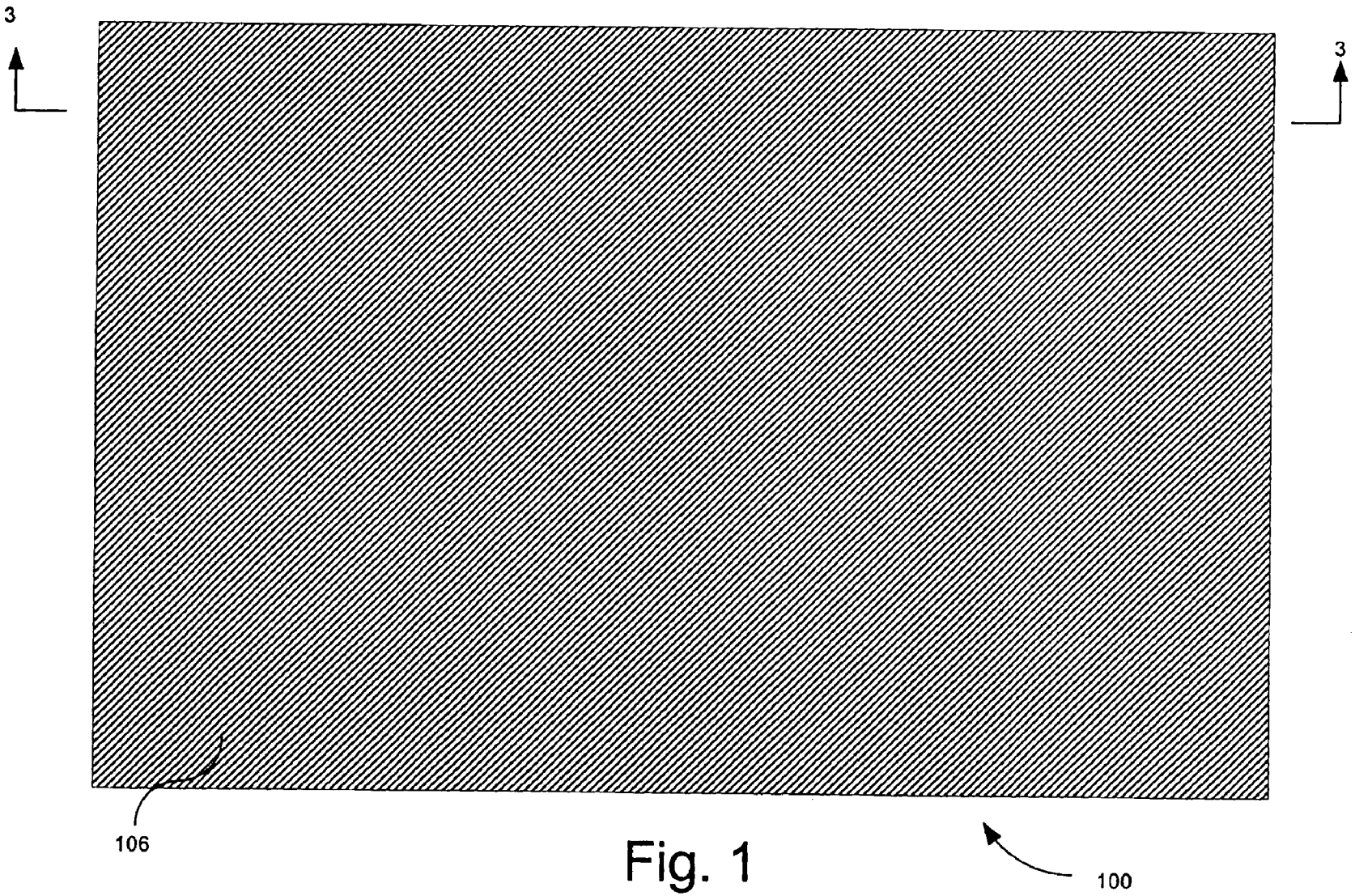
FIG. 1 is a top view of a frequency selective surface that is useful for understanding the invention.
Figure 2:
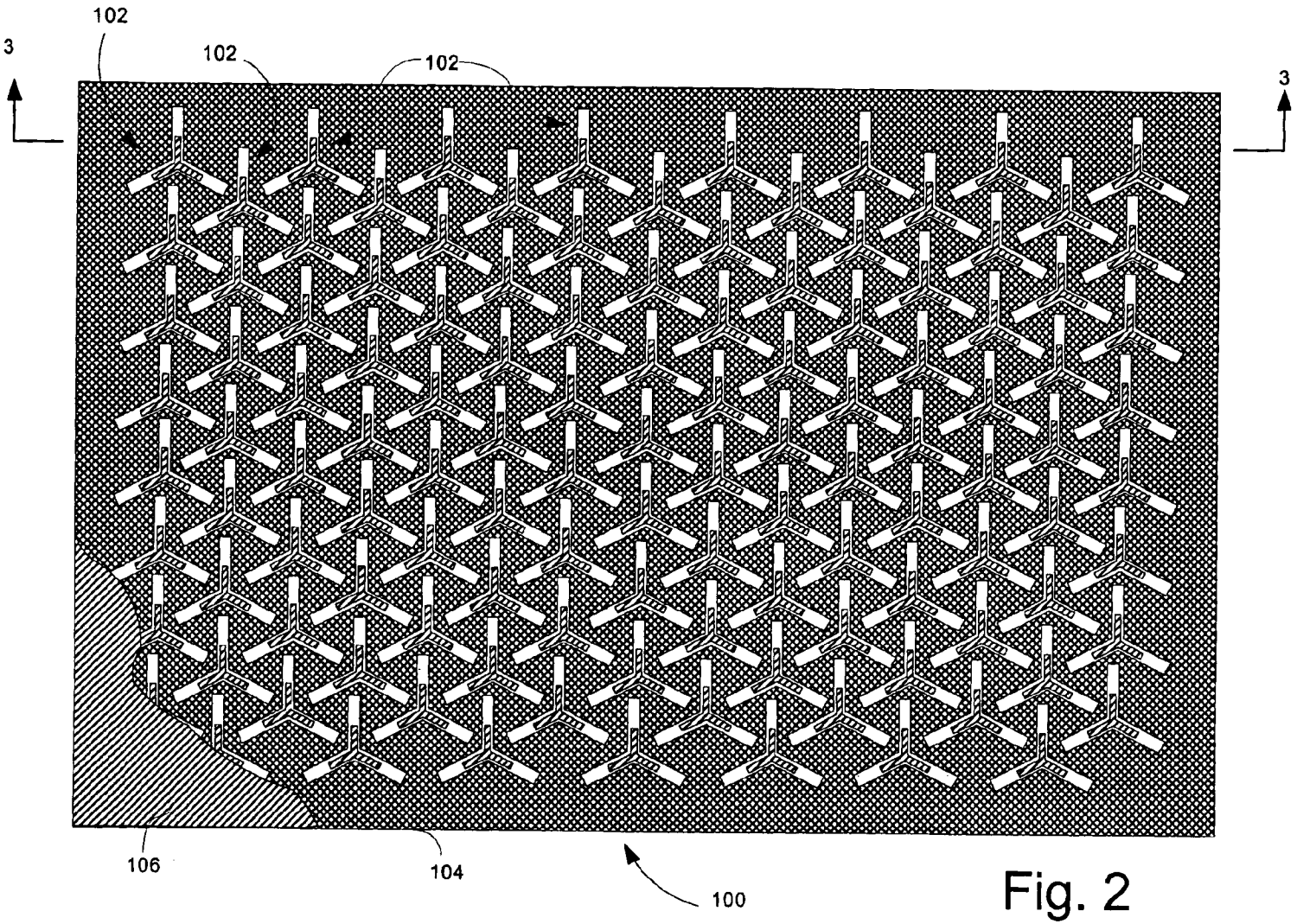
FIG. 2 is a top view of the frequency selective surface in FIG. 1 with a top dielectric layer shown partially cut away.

FIG. 1 is top view of a dynamically variable frequency selective surface 100 covered by a dielectric radome layer 106 . FIG. 2, is a top view of the frequency selective surface 100 with the dielectric radome layer 106 shown partially cut away to reveal the underlying periodic resonance structure. The periodic resonance structure is comprised of a plurality of periodically spaced elements 102.

The plurality of elements 102 can be comprised of periodic perforations of a selected geometry in a surface defined by conductive ground plane 104. According to one embodiment illustrated in FIG. 3, the ground plane 104 can be disposed on a dielectric substrate 108. However, those skilled in the art will appreciate that the invention is not limited to elements that are formed as perforations in a ground plane. For example, the elements can also be formed as metallic patches of selected geometries that are disposed on a dielectric substrate.

Further, it may be noted that the geometry of elements 102 in FIG. 2 is define common tripoles. However, the invention is not limited to any such specific element geometry. Instead, the inventive arrangements as disclosed herein can be applied to elements of any geometry. For example, the elements 102 could also be formed without limitation so as to define, hexagons, circles, crosses, Jerusalem crosses, rings, rectangles and squares.

Figure 4:
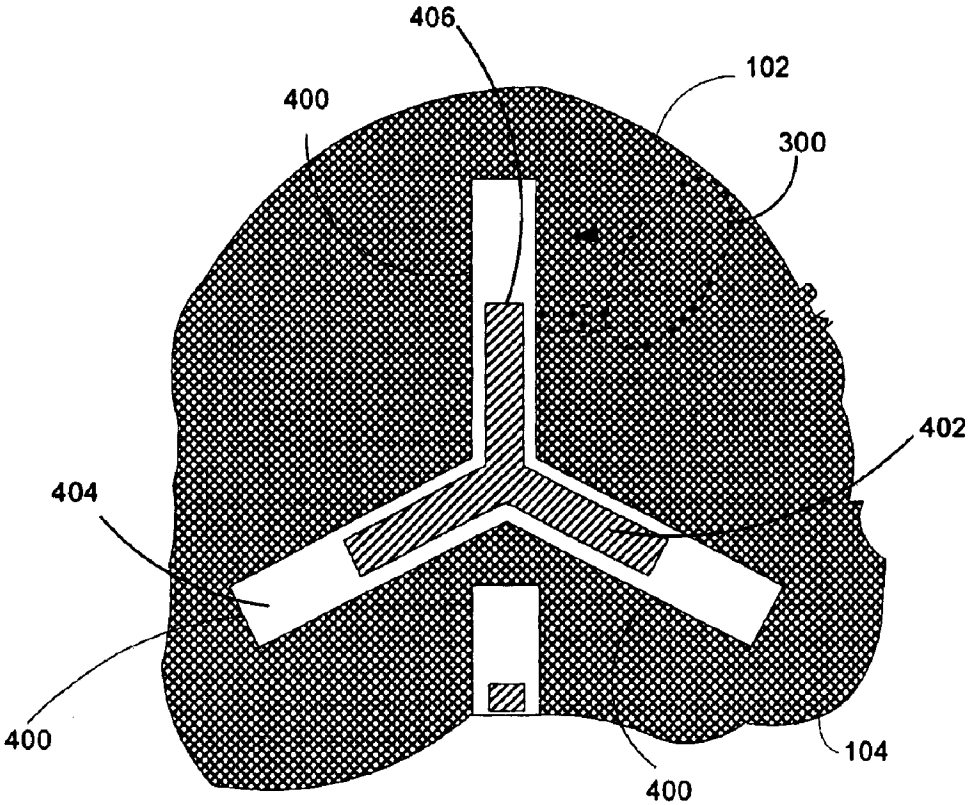
FIG. 4 is an enlarged top view of a single element 102 taken along line 4—4 in FIG. 3.
Figure 5:
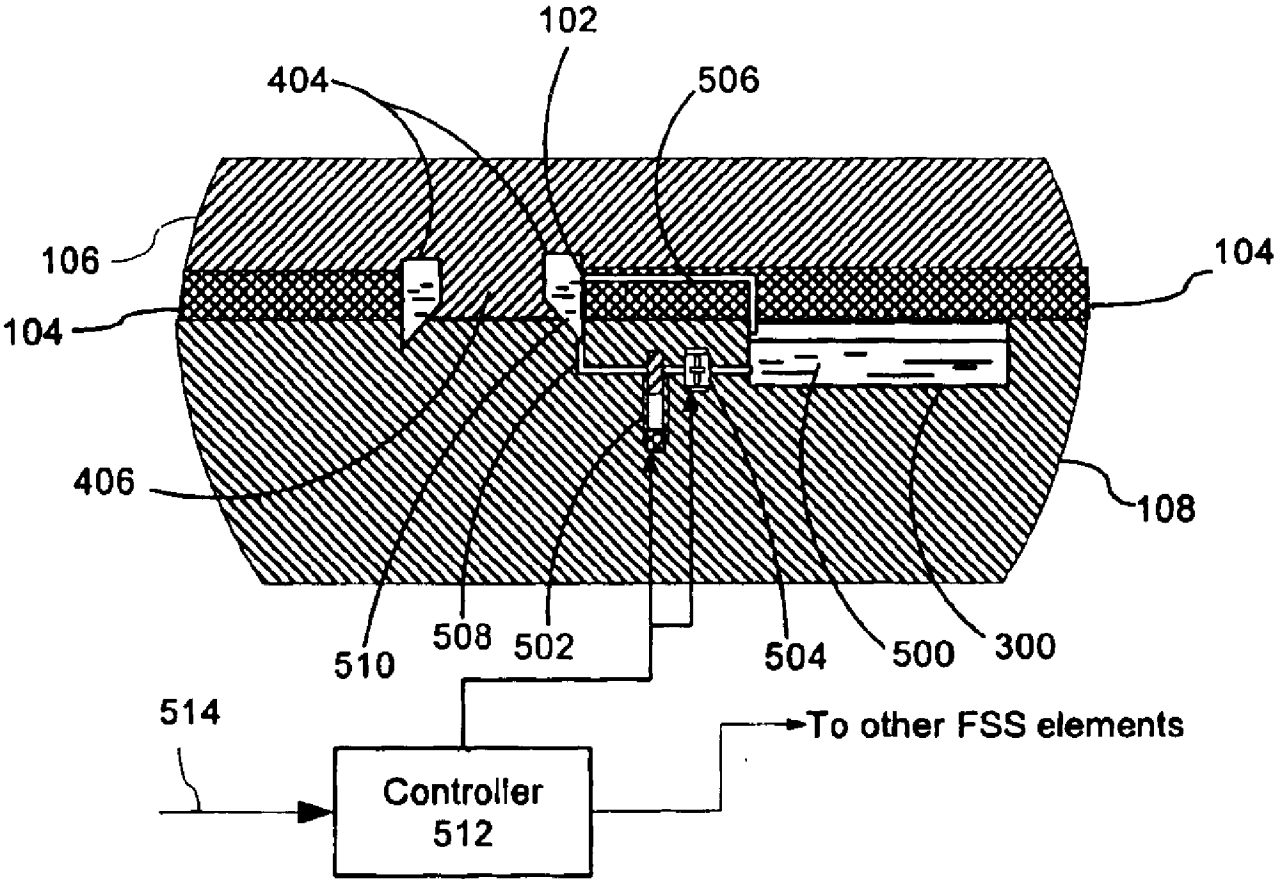
FIG. 5 is an enlarged cross-sectional view of a single element in FIG. 3 identified by line 5—5 in FIG. 3.

Referring now to FIGS. 4 and 5, a channel 404 can be provided extending along at least a portion of the perimeter 400 defining element 102. According to one embodiment shown in FIG. 4, the channel 404 can extend entirely around the perimeter 400, but the invention is not so limited. The channel can be defined on an opposing side by a dielectric form 402 that has an outer perimeter 406. Top and bottom portions of the channel 404 can be provided by dielectric radome 106 and dielectric substrate 108.

The channel 404 is preferably formed adjacent to the conductive ground plane 104 as shown so that at least a portion of the interior surface of the channel 404 is electrically coupled to the surrounding conductive ground plane 102. More particularly, the channel is preferably formed so that when it is filled with a conductive fluid 500, the conductive fluid will form a direct electrical connection to the ground plane 104 along substantially the entire perimeter 400, thereby causing the conductive fluid 500 and the ground plane 104 to be at the same relative potential. Consequently, conductive fluid added to the channel 404 will appear to extend the perimeter 400 of the ground plane to include the portion of the channel 102 that is filled with conductive fluid 500.

According to one embodiment of the invention shown in FIG. 5, channel 404 can have a tapered portion 510 so that variations in the volume of conductive fluid 500 contained in the channel 404 will also vary the degree to which perimeter 400 appears to be extended. Adding more fluid will further extend the ground plane 104 when a volume of the conductive fluid is within this tapered portion. The tapered portion 510 also permits the conductive fluid 500 to efficiently drain from the channel 404 as will be hereinafter described.

According to a preferred embodiment a fluid control system can be provided for controlling the position and volume of conductive fluid in the frequency selective surface 100. According to one embodiment shown in FIGS. 3 and 5, the fluid control system can include at least one cavity structure 300 formed in the dielectric substrate 108 for constraining the conductive fluid 500 when it is not in use. A single cavity structure 300 can be provided for each element 102. However, the invention is not limited in this regard and a single cavity structure 300 can be used to store conductive fluid for two or more elements 102.

Figure 3:
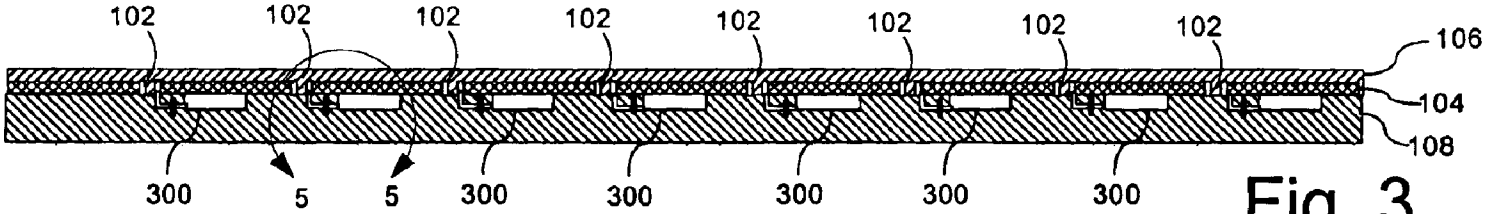
FIG. 3 is a cross-sectional view of the frequency selective surface in FIG. 1 taken along line 3—3.

Similarly, the fluid control system can include suitable components for transferring a volume of conductive fluid 500 to a selected position and maintaining the conductive fluid in that position for a period of time. For example, as shown in FIG. 5, a pump 504 and valve 502 can be used to control the flow of conductive fluid 500 between the channel 404 and the cavity structure 300. Each channel 404 can be provided with its own set of pumps and valves as shown in FIGS. 3 and 5. However, the invention is not limited in this regard and other arrangements are also possible. For example, a single set of pumps and valves can be used to communicate conductive fluid to a plurality of elements 102 with a fluid distribution network (not shown) disposed beneath the conductive ground plane 104.

A fluid conduit 508 can be provided for transferring conductive fluid between the cavity structure 300 and the channel 404. A pressure relief conduit 506 can also be provided for equalizing the pressure as between the cavity structure 300 and the channel 404. A check valve (not shown) can be provided in the pressure relief conduit to prevent conductive fluid from unintentionally returning to the cavity structure 300 through the pressure relief conduit.

Numerous other arrangements will be apparent to those skilled in the art for controlling the volume and position of conductive fluid contained within the channel 404, and all such embodiments are intended within the scope of the present invention.

Advantageously, the fluid control system can also include a controller 512. Controller 512 can be any device capable of receiving an input control signal 514 for the frequency selective surface 100 and selectively controlling the appropriate pumps and valves to produce a desired frequency response. For example, the controller 512 can be an electronic circuit, a microprocessor, a software routine or any combination thereof.

According to one embodiment, the various pumps and valves can be disposed within the dielectric substrate 108 with suitable control circuitry provided. However, the invention is not limited in this regard, and the various pumps and valves can also be disposed external to the substrate. The pumps and valves can be of a conventional miniature variety or, in a preferred embodiment, they can be microelectromechanical systems (MEMS). If MEMS type devices are used, they can be integrated directly into the dielectric substrate 108.

The fluid control system described herein can be used to dynamically vary a position and/or a volume of the conductive fluid 500 within the periodic resonance structure defined by the elements 102. In this way, the conductive fluid 102 can be used to change at least one dimension or a shape of each of the elements 102. This modification of the element dimension and/or shape allows the fluid control system to dynamically modify the resonant frequency or other electrical characteristic of each element.

Control Process

Figure 6:
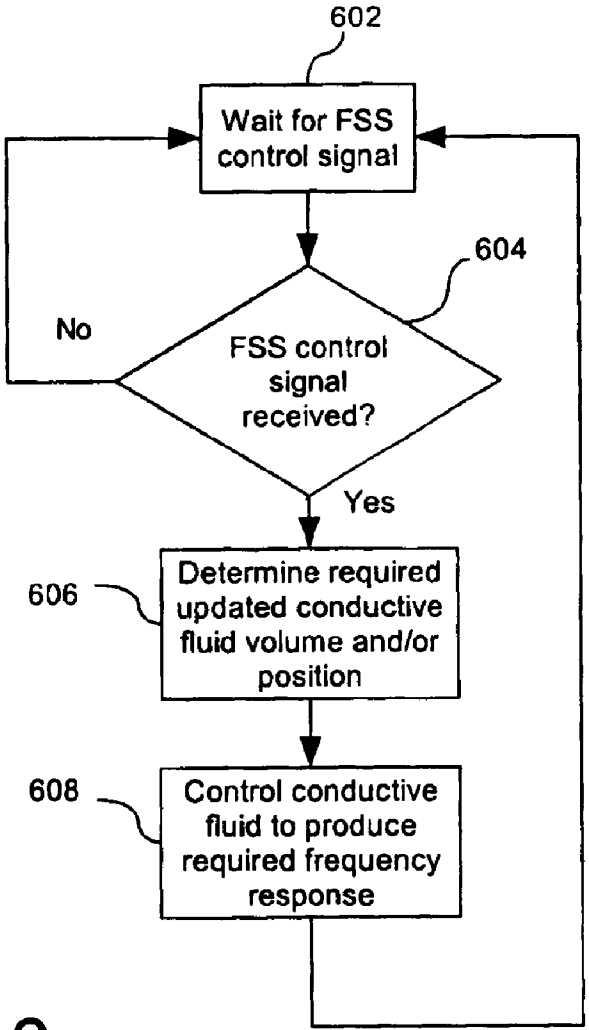
FIG. 6 is a flow chart that is useful for understanding a process for dynamically modifying a frequency selective surface.

Referring now to FIG. 6, a process shall be described for controlling the frequency selective surface 100 as disclosed herein. In step 602 and 604, controller 512 can wait for an antenna control signal 514 indicating a selected pass-band or stop-band operating condition. This selected operating condition can indicate a relatively small change in frequency response or a switch to a different band of frequencies. Once this information has been received, the controller 512 can determine in step 606 a required position and or volume of the conductive fluid 500 that is necessary for the frequency selective surface to perform as requested. In step 508, the controller 512 can selectively operate one or more of the pumps 504 and valves 502 respectively associated with the frequency selective surface 100 to move the proper amount of conductive fluid into or out of the channel 404. Thereafter, the controller 512 can return to a waiting mode for a command indicating the next updated operating condition.

Alternative Geometries

Using the foregoing techniques, a variety of different types of element geometries can be modified in a variety of different ways. As illustrated in FIGS. 7A–7D, elements 102A–102D can be modified by selectively varying a volume of conductive fluid added to channels 404A–404D, respectively. Dielectric forms can be used to define an inner perimeter of the channel.

Figure 7B:
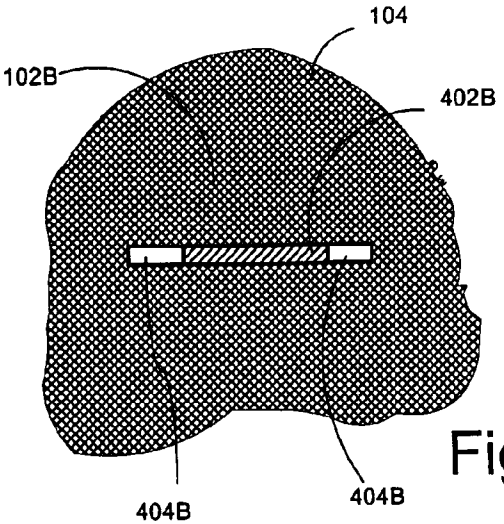
FIGS. 7A–7F are a series of drawings showing alternative element embodiments.
Figure 7A:
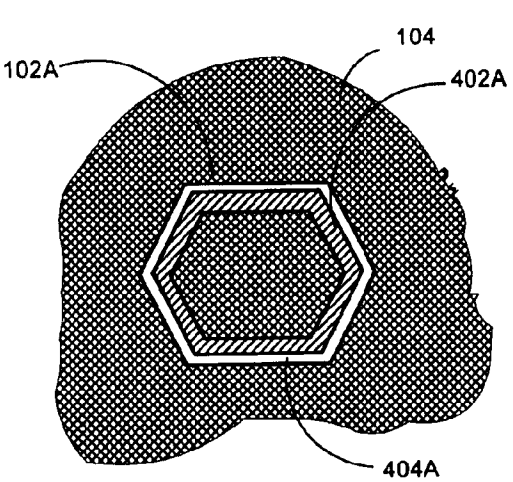
Figure 7D:
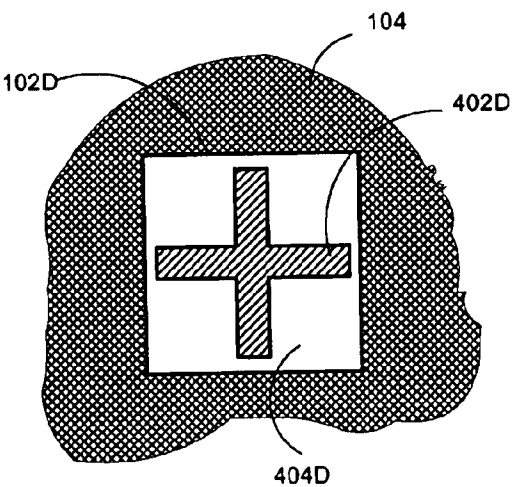
Figure 7C:
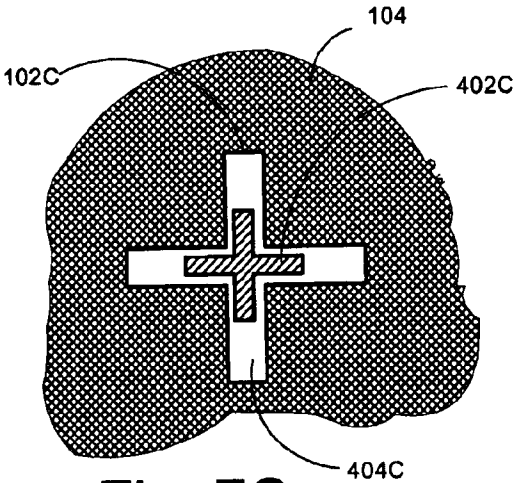
Figure 7E:
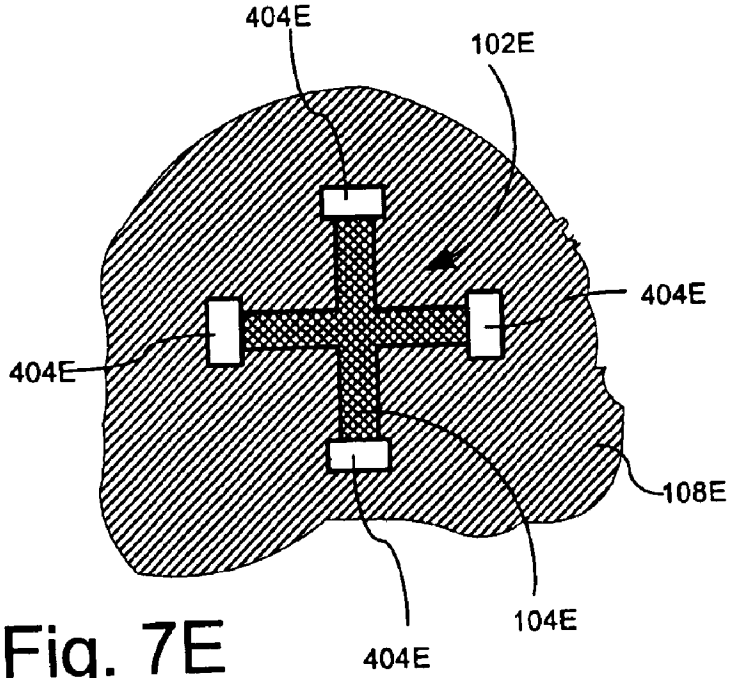
Figure 7F:
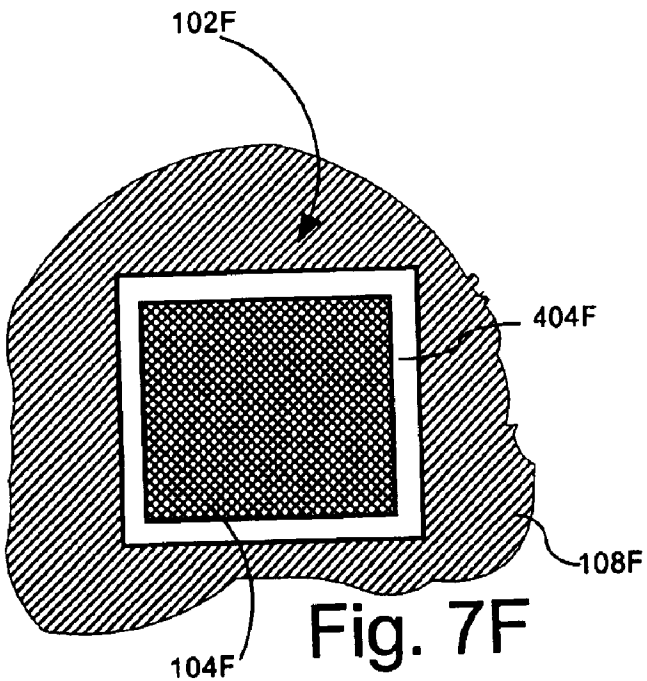

In FIGS. 7E and 7F, instead of perforations in a metal ground plane 104, the elements 102E and 102F can be comprised of conductive patches 104E, 104F formed respectively on the dielectric substrate 108E, 108F. The size or shape of elements 102E and 102F can be modified by controlling a volume of conductive fluid added to channels 404E and 404F, respectively. Notably, in the embodiments illustrated in FIGS. 7E and 7F, the conductive fluid 500 can be stored in a cavity structure directly beneath the element. In each case, the conductive fluid contained in the channels can be electrically coupled to the element. Of course, the various geometries in FIG. 7A–7F are merely examples of some possible geometries, and the invention is not limited to any particular element shape or arrangement.

The Conductive Fluid

According to one aspect of the invention, the conductive fluid used in the invention can be selected from the group consisting of a metal or metal alloy that is liquid at room temperature. The most common example of such a metal would be mercury. However, other electrically-conductive, liquid metal alloy alternatives to mercury are commercially available, including alloys based on gallium and indium alloyed with tin, copper, and zinc or bismuth. Conductive fluids which are electrically conductive and non-toxic, are described in greater detail in U.S. Pat. No. 5,792,236 to Taylor et al, the disclosure of which is incorporated herein by reference. Other conductive fluids include a variety of solvent-electrolyte mixtures that are well known in the art.

A system which relies on the presence or absence of a conductive fluid can also include some means to ensure that no conductive residue remains in/on the walls of the channel 404 when the channel is purged of conductive fluid. In this regard, the channels containing conductive fluid can be flushed with a suitable solvent after the conductive fluid has been otherwise purged. This flushing can be performed manually or by an automated system. For example, in the case of conductive fluids which may consist of particles in solution or suspension, an active purging system (not shown) may be employed which uses a non-conductive fluid to flush the cavities of any remaining conductive particles. Still, the use of such an active purging system is merely a matter of convenience and the invention is not so limited.

Structure, Materials and Fabrication

According to one aspect of the invention, the dielectric substrate 108 and the readome 106 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for dynamically varying a frequency response of a frequency selective surface, comprising the steps of:

controlling a transmission of electromagnetic energy through a surface by passing selected frequencies in a pass-band and blocking selected frequencies in a stop-band; and dynamically modifying at least one of said pass-band and said stop-band by selectively varying at least one of a position and a volume of a conductive fluid forming at least a portion of said surface.

2. The method according to claim 1 further comprising the step of forming a plurality of elements of said frequency selective surface to have a shape selected from the group consisting of tripoles, circles, crosses, Jerusalem crosses, rings, rectangles and squares.

3. The method according to claim 1 further comprising the step of forming a plurality of elements of said frequency selective surface by defining periodic perforations of a selected geometry in a conductive ground plane.

4. The method according to claim 3 wherein said dynamically modifying step further comprises the step of injecting said conductive fluid into a fluid channel formed adjacent to a portion of said conductive ground plane.

5. The method according to claim 4 further comprising the step of electrically coupling said conductive fluid contained in said channel to said conductive ground plane.

6. The method according to claim 3 further comprising the step of disposing said conductive ground plane on a dielectric substrate.

7. The method according to claim 6 further comprising the step of constraining said conductive fluid in a cavity structure defined within said dielectric substrate.

8. The method according to claim 7 further comprising the step of forming said cavity structure within a portion of said dielectric substrate entirely within a boundary defined by said conductive ground plane.

9. The method according to claim 1 further comprising the step of selecting said conductive fluid to be formed of gallium and indium alloyed with a material selected from the group consisting of tin, copper, zinc and bismuth.

10. The method according to claim 1 further comprising the step of varying at least one of said position and said volume of said conductive fluid in response to a control signal.

11. The method according to claim 1 wherein said dynamically modifying step is further comprised of changing at least one dimension of a plurality of periodic elements of said frequency selective surface.

12. The method according to claim 1 wherein said dynamically modifying step is further comprised of changing a shape of said plurality of periodic elements.

13. A dynamically variable frequency selective surface, comprising:

a periodic resonance structure having a plurality of elements periodically spaced over a surface, each of said elements having a resonant frequency;

a conductive fluid; and a fluid control system dynamically varying at least one of a position and a volume of said conductive fluid within said periodic resonance structure to change at least one dimension of said plurality of elements.

14. The dynamically variable frequency selective surface according to claim 13 wherein said plurality of elements are comprised of periodic perforations of a selected geometry in a conductive ground plane.

15. The dynamically variable frequency selective surface according to claim 14 wherein said fluid control system selectively adds and removes said conductive fluid from a fluid channel formed adjacent to a portion of said conductive ground plane.

16. The dynamically variable frequency selective surface according to claim 15 wherein said conductive fluid contained in said channel is electrically coupled to said conductive ground plane.

17. The dynamically variable frequency selective surface according to claim 14 wherein said conductive ground plane is disposed on a dielectric substrate.

18. The dynamically variable frequency selective surface according to claim 17 further comprising a cavity structure defined within said dielectric substrate for storing a predetermined volume of said conductive fluid.

19. The dynamically variable frequency selective surface according to claim 18 wherein said cavity structure is disposed within a portion of said dielectric substrate entirely within a boundary defined by said conductive ground plane.

20. The dynamically variable frequency selective surface according to claim 13 wherein said conductive fluid is comprised of gallium and indium alloyed with a material selected from the group consisting of tin, copper, zinc and bismuth.

21. The dynamically variable frequency selective surface according to claim 13 wherein said fluid control system is responsive to a control signal.

22. The dynamically variable frequency selective surface according to claim 13 wherein said fluid control system dynamically modifies said resonant frequency.

23. The dynamically variable frequency selective surface according to claim 13 wherein said plurality of elements have a shape selected from the group consisting of tripoles, circles, crosses, Jerusalem crosses, rings, rectangles and squares.

24. A dynamically variable frequency selective surface, comprising:

a periodic resonance structure having a plurality of elements periodically spaced over a surface, each of said elements having a resonant frequency;

a conductive fluid; and a fluid control system for dynamically varying at least one of a position and a volume of said conductive fluid within said periodic resonance structure to change a shape of said plurality of elements.

* * * * *